US008888272B2

(12) United States Patent
Hokazono

(10) Patent No.: US 8,888,272 B2
(45) Date of Patent: Nov. 18, 2014

(54) INK JET RECORDING APPARATUS

(75) Inventor: Yutaka Hokazono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/550,128

(22) Filed: Jul. 16, 2012

(65) Prior Publication Data

US 2013/0021414 A1 Jan. 24, 2013

(30) Foreign Application Priority Data

Jul. 19, 2011 (JP) ..... 2011-158183

(51) Int. Cl.

| | |
|---|---|
| ***B41J 2/01*** | (2006.01) |
| ***B41J 2/17*** | (2006.01) |
| ***B41J 11/06*** | (2006.01) |
| ***B41J 11/00*** | (2006.01) |
| *B41J 23/00* | (2006.01) |

(52) U.S. Cl.

CPC ..... *B41J 2/1721* (2013.01); *B41J 11/06* (2013.01); *B41J 11/0065* (2013.01); *B41J 11/0085* (2013.01)

USPC ..... 347/104; 347/37

(58) Field of Classification Search

CPC ..... B41J 11/06; B41J 11/0085; B41J 11/20; B41J 11/0055; B41J 11/0065; B41J 11/02

USPC ..... 347/16, 37, 85, 101, 104

See application file for complete search history.

(56) References Cited

U.S. PATENT DOCUMENTS

| | | | | |
|---|---|---|---|---|
| 7,172,263 | B2 * | 2/2007 | Takatsuka et al. | 347/32 |
| 8,474,971 | B2 * | 7/2013 | Okazaki | 347/104 |
| 2002/0070991 | A1 * | 6/2002 | Otsuki | 347/16 |
| 2004/0239742 | A1 * | 12/2004 | Hiraki et al. | 347/104 |
| 2005/0093951 | A1 * | 5/2005 | Takatsuka et al. | 347/101 |
| 2006/0170751 | A1 * | 8/2006 | Yokoyama et al. | 347/104 |
| 2007/0132799 | A1 * | 6/2007 | Ilda | 347/16 |
| 2007/0132824 | A1 * | 6/2007 | Iida et al. | 347/101 |
| 2007/0146456 | A1 * | 6/2007 | Tanabe | 347/101 |
| 2009/0244245 | A1 * | 10/2009 | Mitsuhashi et al. | 347/104 |
| 2009/0251522 | A1 * | 10/2009 | Koike | 347/104 |
| 2009/0284575 | A1 * | 11/2009 | Verhoest et al. | 347/104 |
| 2010/0214343 | A1 * | 8/2010 | Yamaguchi et al. | 347/16 |
| 2011/0293346 | A1 * | 12/2011 | Sato | 400/578 |

FOREIGN PATENT DOCUMENTS

JP 2006-231612 A 9/2006

* cited by examiner

*Primary Examiner* — Matthew Luu
*Assistant Examiner* — Patrick King
(74) *Attorney, Agent, or Firm* — Canon USA Inc. IP Division

(57) ABSTRACT

A recording apparatus executes recording with a recording head that discharges ink. The recording apparatus includes a platen arranged opposite the recording head and configured to support a sheet, at least one ink receiving portion arranged on the platen and configured to receive ink running off a side edge of the sheet, a suction portion configured to suction fluid from the ink receiving portion, and a supporting member configured to support the sheet at the ink receiving portion to prevent the sheet from sinking into the ink receiving portion.

15 Claims, 18 Drawing Sheets

MODE 1
BORDERED LARGE- TO SMALL-WIDTH SHEETS

MODE 2
BORDERLESS LARGE-WIDTH SHEET

MODE 3
BORDERLESS MEDIUM-WIDTH SHEET

MODE 4
BORDERLESS SMALL-WIDTH SHEET

IMMEDIATELY AFTER PRINTING STARTS (ROLL SHEET, CUT SHEET)

IMMEDIATELY BEFORE PRINTING ENDS (CUT SHEET)

INK JET RECORDING APPARATUS

BACKGROUND OF THE INVENTION

1. Field of the Invention

The present invention relates to a recording apparatus that executes recoding on a sheet by discharging liquid.

2. Description of the Related Art

FIGS. 14 and 15 illustrate a conventional ink jet recording apparatus. A conveyance roller 1, a pinch roller 2, a platen 3, and a cutter 10 are sequentially arranged in the traveling direction of a roll sheet P1 conveyed through a roll sheet conveyance path from an automatic document feeder. The conveyance roller 1 and the pinch roller 2 convey the roll sheet P1 conveyed through the roll sheet conveyance path to an image recording unit to execute recording.

The image recording unit includes a platen 3 that suctions and supports the roll sheet P1 and a recording head 4 that is arranged opposite the platen 3, moves in a main-scanning direction, and discharges ink on the roll sheet P1 on the platen 3 to execute recording. The recording head 4 has a plurality of nozzle arrays (not illustrated) discharging ink on a surface facing the roll sheet P1. These nozzle arrays are arrayed in a sub-scanning direction, and each nozzle array discharges ink of a different color. The nozzle arrays are supplied with ink of the respective colors from respective ink tanks via respective supply tubes.

A carriage 16 including the recording head 4 is slidably supported by a guide shaft 18 and a guide rail 19 parallel to each other. Both ends of the guide shaft 18 and the guide rail 19 are fixed to frames of a printer body 17. A belt drive device and a motor (not illustrated) can reciprocally move the carriage 16 in the main-scanning direction along the guide shaft 18 and the guide rail 19.

When the ink jet recording apparatus records an image, the recording head 4 first executes recording corresponding to a single scanning line, and then temporarily stops the printing operation. After the conveyance roller 1 conveys the roll sheet P1 by a predetermined length, the recording head 4 again executes recording corresponding to the next single scanning line. Thus, by reciprocally moving the carriage 16 and discharging ink from the recording head 4, the ink jet recording apparatus records a desired image on the roll sheet P1. When a cut sheet is used, a discharge roller 30 conveys the trailing edge of the cut sheet.

Next, a configuration of the platen 3 will be described with reference to FIG. 16. Sheet suction portions 5 for suctioning and supporting the roll sheet P1 on the platen 3 include ribs 11 formed at intervals in the main-scanning direction of the carriage 16. On a bottom surface of a recessed portion 12 arranged between each pair of ribs 11, a suction hole 7 is formed. Each suction hole 7 is in communication with a suction force generation unit and keeps the recessed portions 12 in negative pressure to prevent floating of the roll sheet P1.

If the interval between each pair of ribs 11 is increased, the roll sheet P1 sinks between the ribs 11, and the recording head 4 is less likely to rub against the roll sheet P1. However, if the roll sheet P1 excessively sinks between the ribs 11, visible marks are left on the printed roll sheet P1, resulting in degradation of image quality. Thus, an optimum interval value between each pair of ribs 11 is a very important parameter to keep image quality.

In addition, ink receiving portions for borderless printing are arranged on the platen 3. Japanese Patent Application Laid-Open No. 2006-231612 discusses a configuration of ink receiving portions. These ink receiving portions need to have a certain width in the main-scanning direction, being reserved for dealing with misalignment of sheet edges caused when a sheet is set, for example.

According to Japanese Patent Application Laid-Open No. 2006-231612, a plurality of ink receiving portions are arranged, so that when printing is executed on a large-width sheet, the ink receiving portions for smaller-width sheets are covered by the large-width sheet.

As illustrated in FIGS. 17A and 17B, ribs are also arranged on both sides of each ink receiving portion in the main-scanning direction, and the interval of these ribs is greater than the optimum interval of the other ribs corresponding to the sheet suction portions 5 (the portions other than the ink receiving portions on the platen 3). Each of the ink receiving portions needs to have a sufficient width to receive discharged ink that is intentionally caused to run off the sheet during borderless printing.

Further, when a roll sheet is set, the roll sheet could be misaligned and conveyed with some misalignment amount in the sheet width direction. For such a case, each of the ink receiving portions needs to have an extra width. In addition, to prevent running-off ink from flowing into the sheet suction portions 5, each of the ink receiving portions needs to have a minimum extra width.

Thus, when a large-width sheet is printed, the sheet can sink between ribs on both sides of an ink receiving portion for a small-width sheet. In reaction to this sinking portion, the portions adjacent thereto are easily floated. Even if the sheet does not sink, due to significant changes in the rib pitch, the expansion amounts of the sheet swelled by ink can be collected. These factors cause various problems such as irregular wavy marks left visible near the ink receiving portions, image unevenness due to a decrease in accuracy of ink placement, or friction produced between the recording head and the sheet.

SUMMARY OF THE INVENTION

The present invention is directed to a recording apparatus capable of preventing degradation of image quality near the ink receiving portions.

According to an aspect of the present invention, there is provided a recording apparatus to execute recording with a recording head that discharges ink. The recording apparatus includes a platen arranged opposite the recording head and configured to support a sheet, at least one ink receiving portion arranged on the platen and configured to receive ink running off a side edge of the sheet, a suction portion configured to suction fluid from the ink receiving portion, and a movable supporting member configured to support the sheet at the ink receiving portion to prevent the sheet from sinking into the ink receiving portion.

According to exemplary embodiments of the present invention, degradation of image quality near the ink receiving portions can be prevented.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
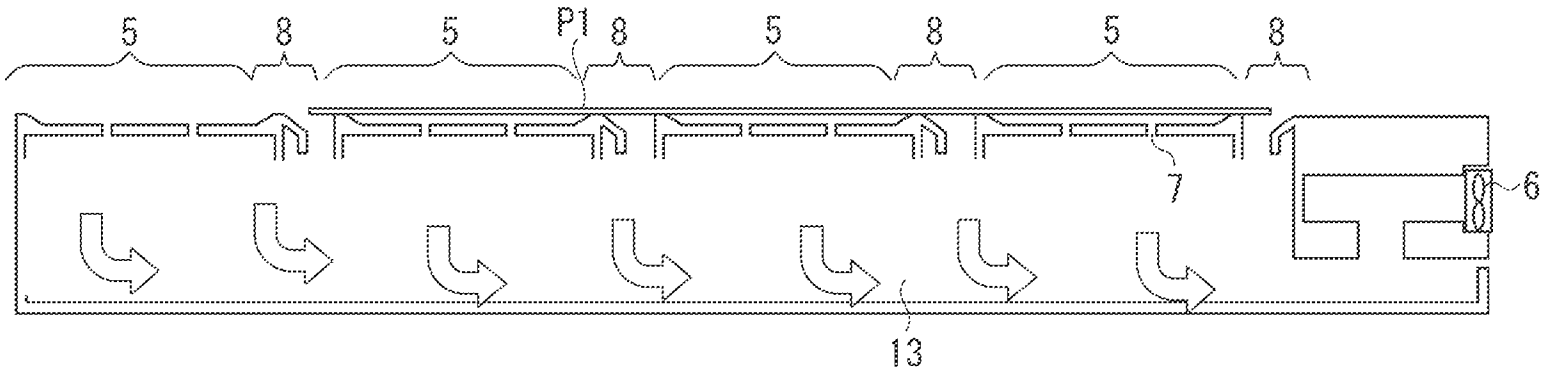
FIG. 1 is a schematic diagram illustrating a suction mechanism under a platen according to a first exemplary embodiment.

FIG. 1 illustrates a suction mechanism under a platen 3 facing a recording head 4. A negative pressure chamber 13, which is a suction portion including a scirocco fan 6 as a suction force generation unit, is arranged under the platen 3. This scirocco fan 6 keeps the negative pressure chamber 13 in negative pressure, and suction holes 7 are made to communicate with the negative pressure chamber 13. In this way, the platen 3 can generate high suction force. With the scirocco fan 6, the size of the suction force generation unit can be reduced.

In addition, at least one pair of ink receiving portions 8 in a concave shape with respect to a conveyed sheet is arranged on the left and right side edges of a sheet (recording medium). The ink receiving portions 8 receive and collect ink discharged to the outside of the side edges of the sheet during borderless printing. Each of the ink receiving portions 8 is also in communication with the negative pressure chamber 13 via an ink suction port 9 that suctions air and fluid including floating mist. Each of the ink receiving portions 8 has an inclined bottom surface, so that the ink discharged to the outside of the sheet flows down this inclined bottom surface and drops in the corresponding ink suction port 9, where the ink is collected.

In the present exemplary embodiment, each ink suction port 9 also functions as an air suction port. However, an air suction port may be provided separately. The ink receiving portions 8 are arranged on the left and right side edges of various sheet widths for which the inkjet recording apparatus can execute borderless printing. After printing, a conveyance roller 1 conveys a sheet P1, and a cutter 10 cuts the printed sheet P1 at a desired position of the trailing edge thereof.

Since each of the suction holes 7 for suctioning the sheet P1 is in communication with the suction force generation unit 6, each of sheet suction portions 5 can generate suction force. Similarly, the ink receiving portions 8 arranged at the left and right sides of each sheet width are in communication with the suction force generation unit 6 and thus generate suction force. Air suctioned through the suction force generation unit 6 is discharged to the outside of the ink jet recording apparatus via a filter (not illustrated).

Next, a movable rib 21*a* serving as a supporting member movably installed in each ink receiving portion 8 will be described with reference to FIGS. 2A to 4B, 13A, and 13B. The movable ribs 21*a* are characteristic portions of the present invention.

Figure 2A:
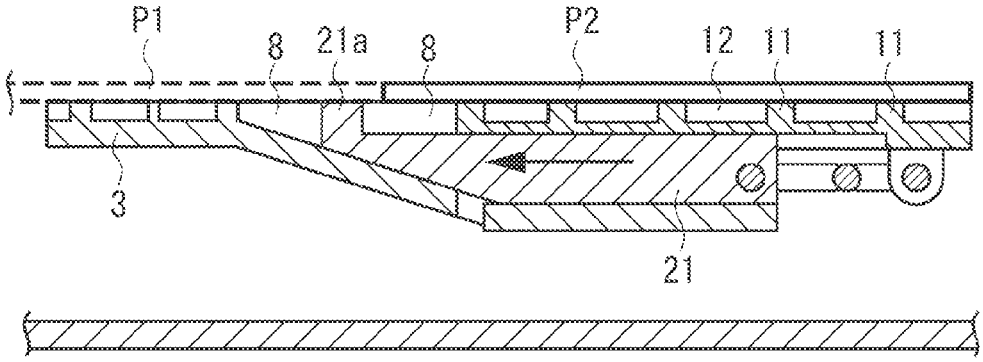
FIGS. 2A and 2B are configuration diagrams illustrating a movable rib according to the first exemplary embodiment.
Figure 2B:
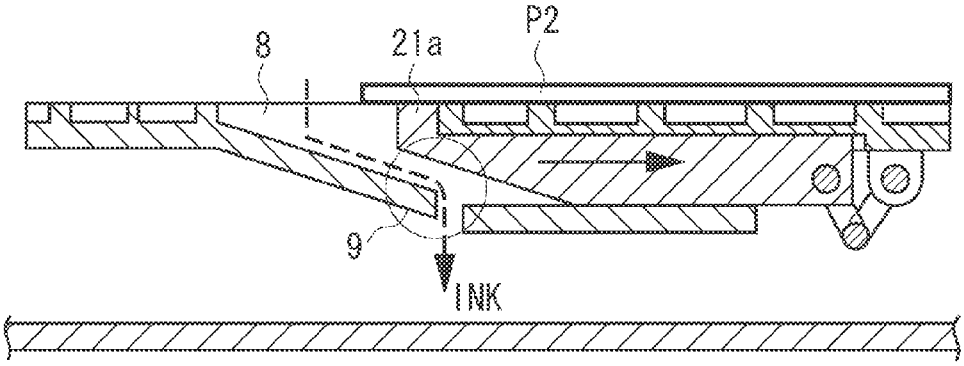
Figure 3B:
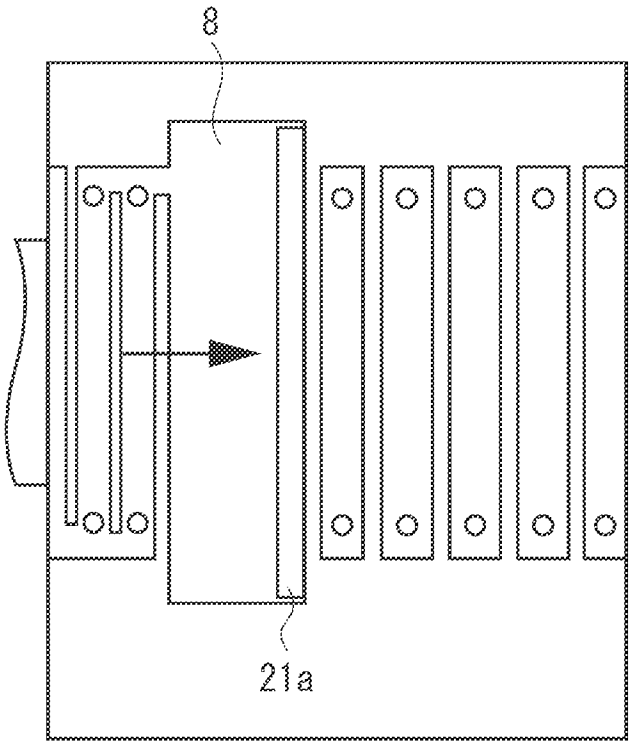
FIGS. 3A and 3B are configuration diagrams illustrating the movable rib according to the first exemplary embodiment.
Figure 3A:
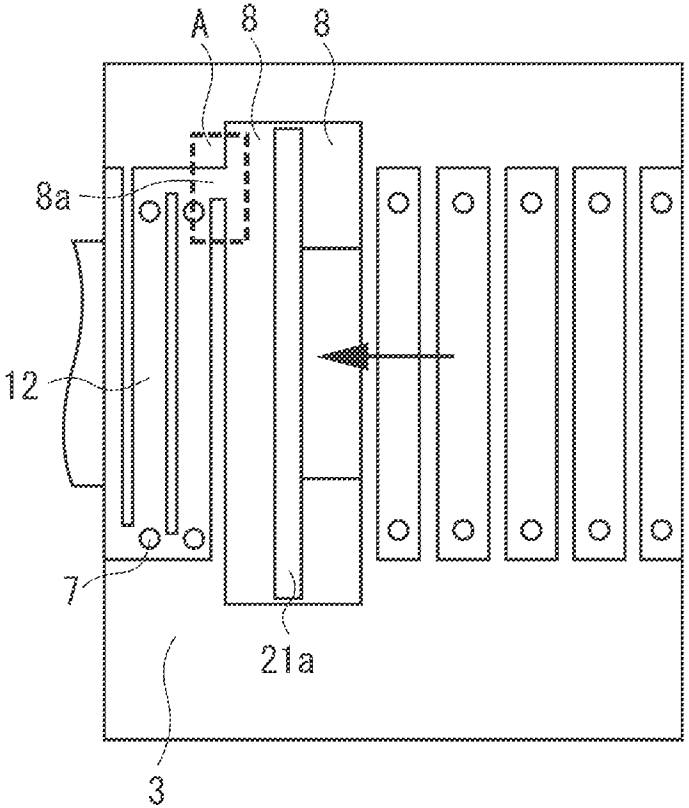

FIGS. 2A and 2B are sectional views of an ink receiving portion 8, which is taken along a line in the main-scanning direction, and FIGS. 3A and 3B are plain views of the ink receiving portion 8, which is viewed from above. A slide member 21 is arranged under ribs 11 and recessed portions 12 and is slidable in the main-scanning direction. Each slide member 21 includes a movable rib 21*a* that supports the sheet.

Each of FIGS. 2A and 3A illustrates the position of a slide member 21 when normal printing (printing that leaves a margin on the side edges) is executed on a sheet P2 in a size corresponding to the ink receiving portion 8 or recording is executed on a sheet P1 in a size covering the ink receiving portion 8. In such printing, the slide member 21 moves so that the movable rib 21*a* serving as a supporting member is positioned approximately in the middle of the ink receiving portion 8 in the main-scanning direction (hereinafter, this position of the movable rib 21*a* will be referred to as "a sheet supporting position" or "a second position").

When t recording is executed on the sheet P1 (indicated by a dashed line in FIG. 2A) in a size covering the ink receiving portion 8, the inside of the ink receiving portion 8 covered by the sheet P1 is kept in negative pressure, and the movable rib 21*a* supports the sheet P1 from below. Simultaneously, the slide member 21 closes the ink suction port 9 while maintaining a little clearance. This prevents the sheet from significantly sinking into the ink receiving portion 8. When recording is executed on the sheet P2 in a size corresponding to the ink receiving portion 8 (a sheet having a side edge positioned at the ink receiving portion 8), the movable rib 21*a* is positioned at the outside of the side edge of the sheet P2.

Each of FIGS. 2B and 3B illustrates the position of the slide member 21 when borderless printing is executed on the sheet P2 having a side edge positioned at the ink receiving portion 8. As illustrated in FIGS. 2B and 3B, the movable rib 21*a* is retracted to an end portion of the ink receiving portion 8 (hereinafter, this position of the movable rib 21*a* will be referred to as "a retracted position" or "a first position"). This movement of the movable rib 21*a* widely opens the ink receiving portion 8. Simultaneously, the slide member 21 opens the ink suction port 9. The ink receiving member 8 collects the ink running off the sheet edge.

According to the present exemplary embodiment, as illustrated in FIG. 2B, the retracted position is a position where the movable rib 21*a* of the slide member 21 is hidden under the sheet P2. In this way, during borderless printing, the movable rib 21*a* is not stained with the ink running off the sheet end. As long as the movable rib 21*a* is hidden under the sheet P2, for example, the movable rib 21*a* may be moved until the movable rib 21*a* hits the right-side rib in FIG. 2B or the movable rib 21*a* may be slid under the right-side rib (if viewed from above, the movable rib 21*a* of the slide member 21 overlaps with the right-side rib).

Figure 4B:
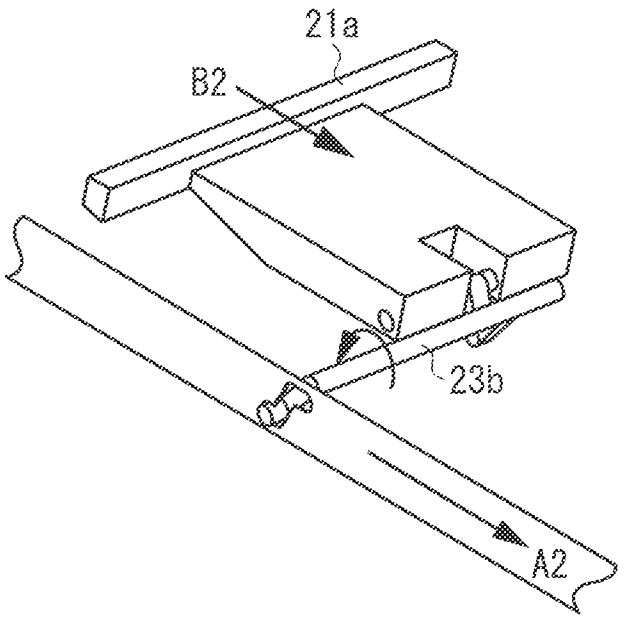
FIGS. 4A and 4B are configuration diagrams illustrating the movable rib according to the first exemplary embodiment.
Figure 4A:
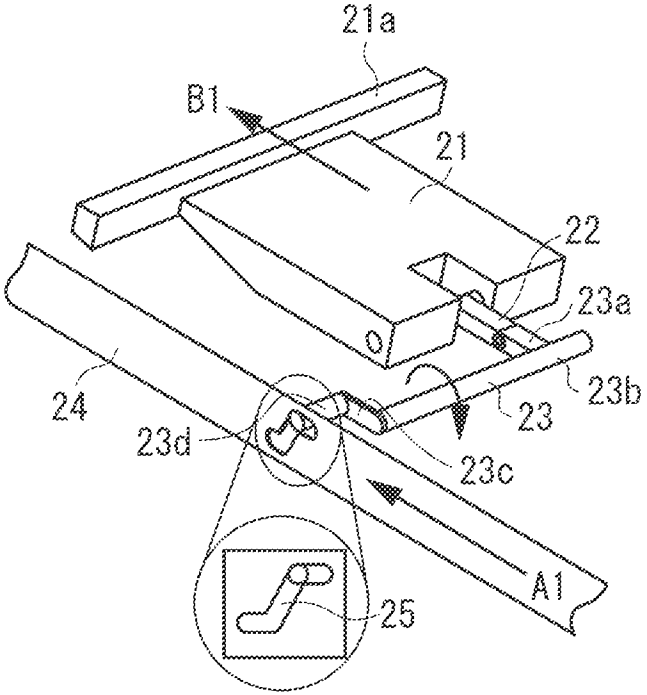

As illustrated in FIGS. 4A and 4B, the slide member 21 is connected to a crank 23 via an arm 22. The arm 22 has one end rotatably coupled to the slide member 21 and the other end rotatably coupled to an arm 23*a* that extends from the crank 23. The crank 23 is rotatably supported by a crank shaft 23*b*, and a crank pin 23*d* extending in parallel with the crank shaft 23*b* is formed on an arm portion 23*c* extending perpendicularly from the crank shaft 23*b*. The arm 23*a*, the crank shaft 23*b*, the arm portion 23*c*, the crank pin 23*d* are formed integrally. By passing the crank pin 23*d* through a link groove 25 formed in a link member 24, the crank 23 engages with the link member 24.

A drive unit 250 can reciprocally and linearly move the link member 24 in arrow directions A1 and A2 in FIGS. 4A and 4B, respectively. The operation principal is as follows. When the link member 24 reciprocally and linearly moves, the arm portion 23*d* is rotated, the arm 23*a* is rotated around the crank shaft 23*b*, and the slide member 21 coupled to the arm 23*a* is slid via the arm 22. FIG. 4A illustrates the movable rib 21*a*, which is moved in an arrow direction B1 to the sheet supporting position, and FIG. 4B illustrates the movable rib 21*a*, which is moved in an arrow direction B2 to the retracted position.

According to the present exemplary embodiment, as the movable rib 21*a* is moved to the sheet supporting position, the ink suction port 9 is closed, and as the movable rib 21*a* is moved to the retracted position, the ink suction port 9 is opened. Since the ink suction port 9 is opened/closed along with movement of the movable rib 21*a*, the wind speed at the ink receiving portion 8 is reduced. As a result, accuracy of ink placement near the ink receiving portion 8 is improved.

Even if the movable rib 21*a* in the ink receiving portion 8 covered by the sheet closes the ink suction port 9, the suction force for suctioning the sheet is not reduced. This is because, as illustrated by portion A surrounded by a dotted line in FIG. 3A, the ink receiving portion 8 is connected to a recessed portion 12 by a suction path 8*a* and is kept in negative pressure by a suction hole 7. Another reason is that some clearance exists between the slide member 21 and the ink suction port 9.

Figure 5:
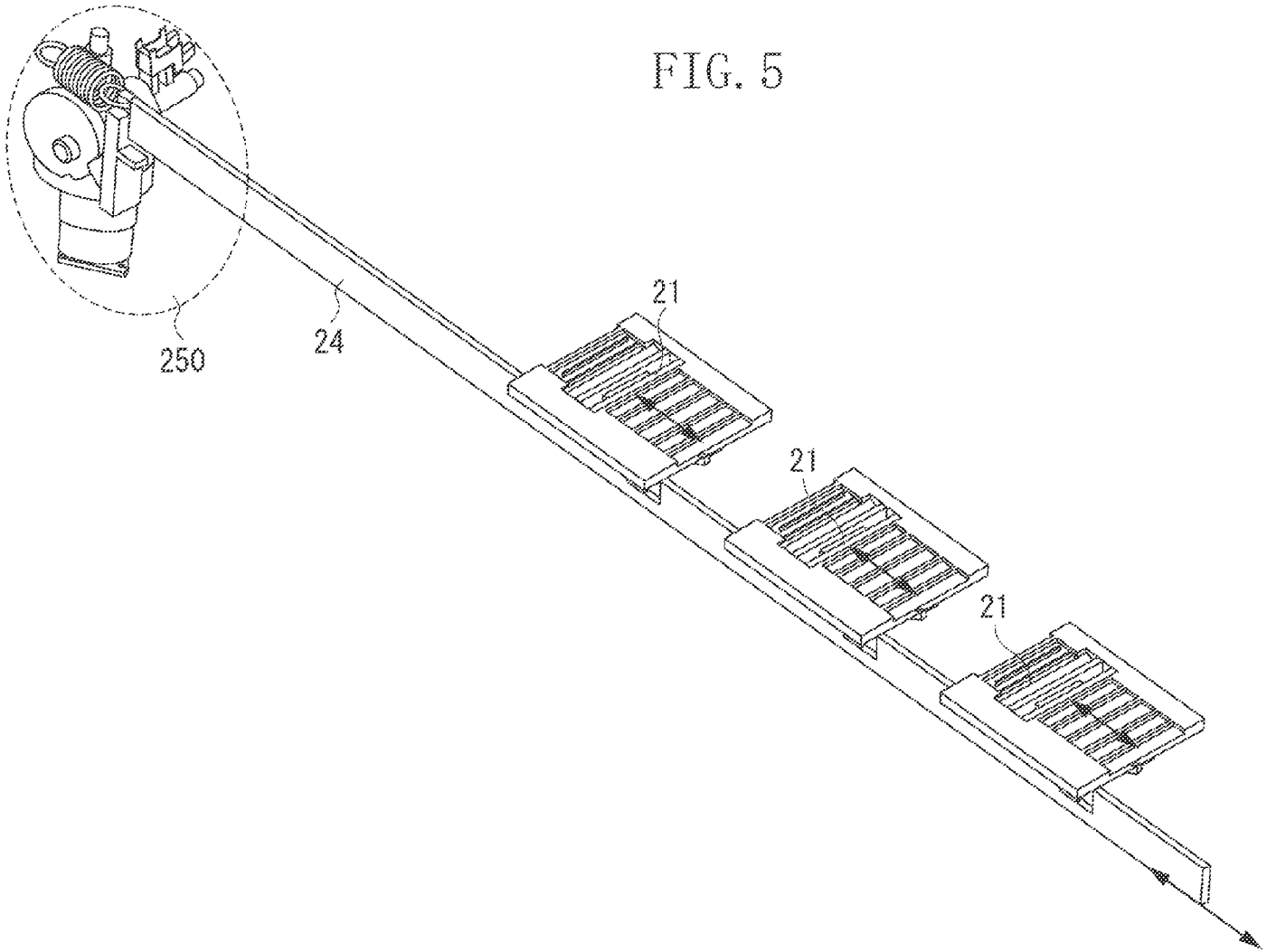
FIG. 5 is a configuration diagram illustrating a movable rib unit according to the first exemplary embodiment.

As illustrated in FIG. 5, the ink receiving portions 8 are arranged at a plurality of positions in order to support a plurality of sheet widths. Each of the ink receiving portions 8 is coupled to the link member 24 and each of the slide members 21 is simultaneously moved by the drive unit 250.

Figure 6B:
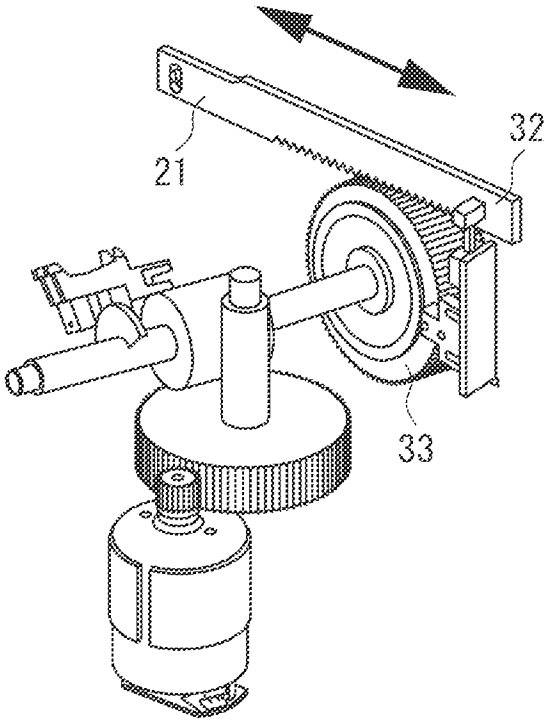
FIGS. 6A and 6B are configuration diagrams illustrating a drive unit according to the first exemplary embodiment.
Figure 6A:
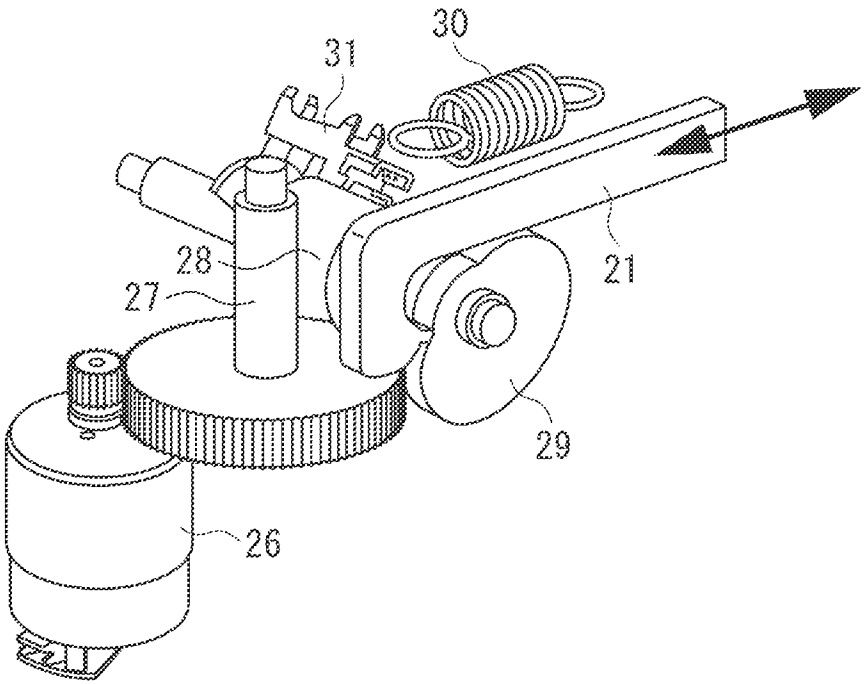

FIG. 6A illustrates the drive unit 250 in detail. A motor 26 rotates a cam 29 via a worm 27 and a worm wheel 28. The cam 29 and an urging spring 30 reciprocally and linearly move the link member 24. In addition, a sensor 31 reads the rotational position of the cam 29. Alternatively, the drive unit 250 may be configured as illustrated in FIG. 6B. In FIG. 6B, instead of the cam 29, the drive unit 250 includes a rack 32 and a pinion gear 33. Further alternatively, the drive unit 250 may include the rack 32 and the pinion gear 33, along with the cam 29.

Figure 7:
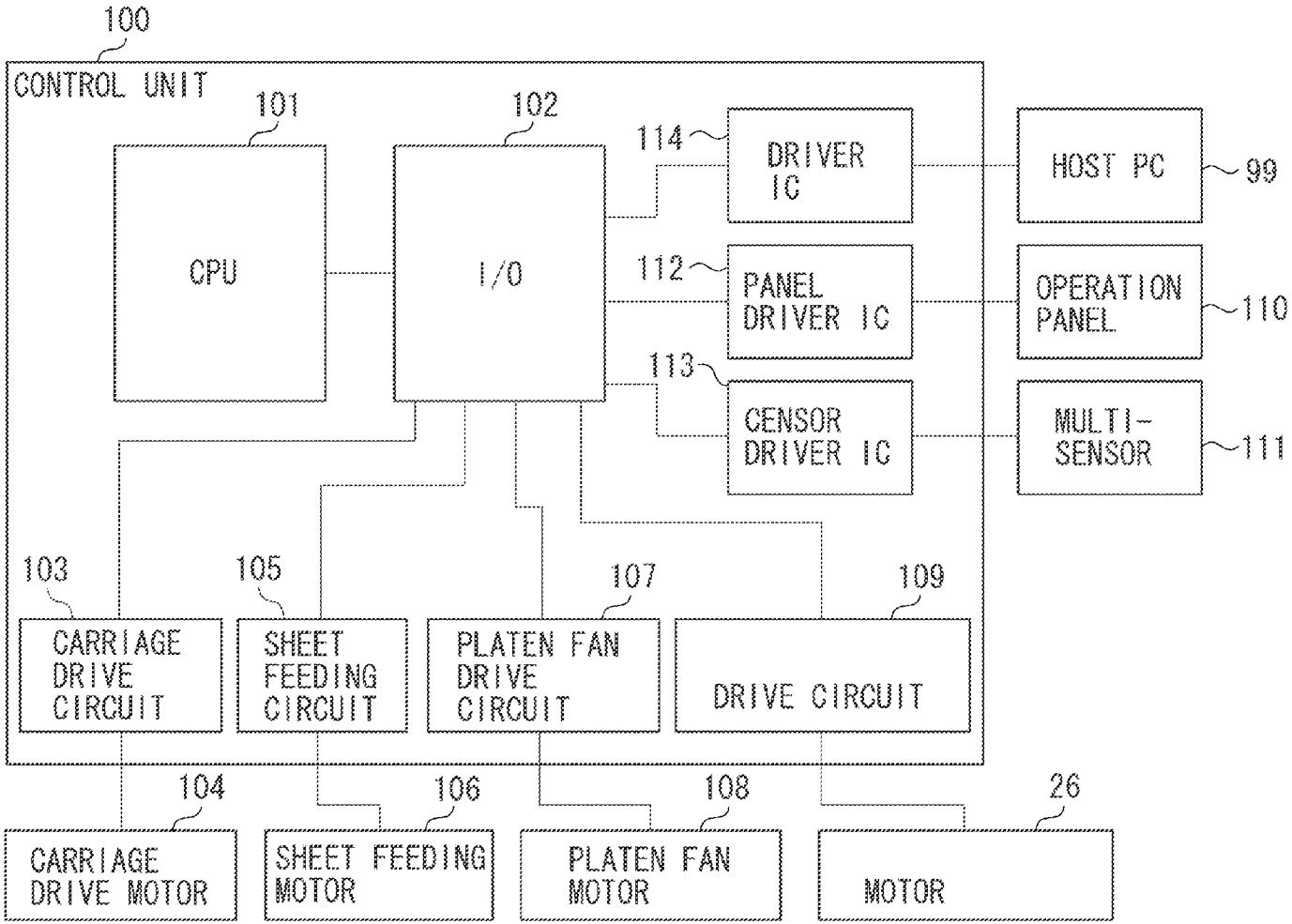
FIG. 7 is a block diagram illustrating movable ribs according to the first exemplary embodiment.

FIG. 7 is a block diagram of a control unit 100 of the ink jet recording apparatus. The control unit 100 includes a central processing unit (CPU) 101, which is connected to various motors via an input/output (I/O) 102 and various drive circuits. More specifically, the control unit 100 includes a carriage drive circuit 103 connected to a carriage drive motor 104 for reciprocally moving a carriage 16, a sheet feeding circuit 105 connected to a sheet feeding motor 106 for driving the conveyance roller 1, a platen fan drive circuit 107 connected to a platen fan motor 108 for driving the scirocco fan 6, and a drive circuit 109 for driving the motor 26 of the drive unit 250.

An operation panel 110 and a multi-sensor 111 are connected to the I/O 102 via drivers IC 112 and 113, respectively. A host personal computer (PC) 99 is connected to the I/O 102 via a driver IC 114. If the CPU 101 receives image data from the host PC 99, depending on quality of the image, the scanning speed of the carriage 16, the number of sheet feeding passes, the suction duty of the platen fan, and the positions of the movable ribs 21*a* are determined. Along with the image data, the host PC 99 supplies the CPU 101 with information specifying normal printing or borderless printing and information specifying a roll sheet or a cut sheet.

Next, movement of the movable ribs 21*a* will be described in detail with reference to FIGS. 8A to 8D, 9A to 9D, and 10. The movable ribs 21*a* are moved to different positions, depending on the print condition. FIGS. 8A to 8D illustrate the sheet supporting positions and the retracted positions to which the movable ribs 21*a* in the respective ink receiving portions 8-1 to 8-4 are moved under various print conditions.

Figures 8A, 8B, 8C, 8D:
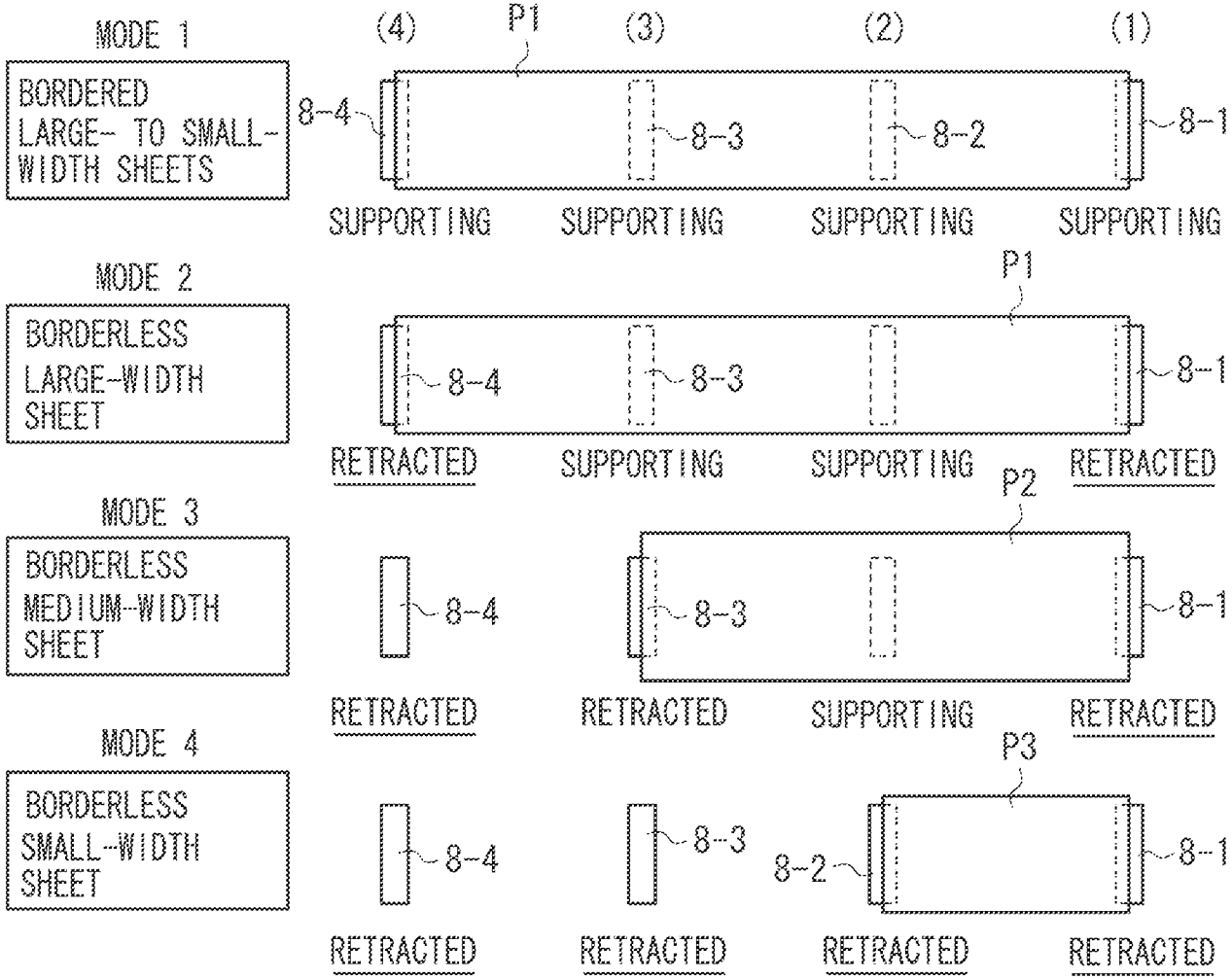
FIGS. 8A, 8B, 8C, and 8D illustrate movement of the movable ribs according to the first exemplary embodiment.
Figures 9A, 9B, 9C, 9D:
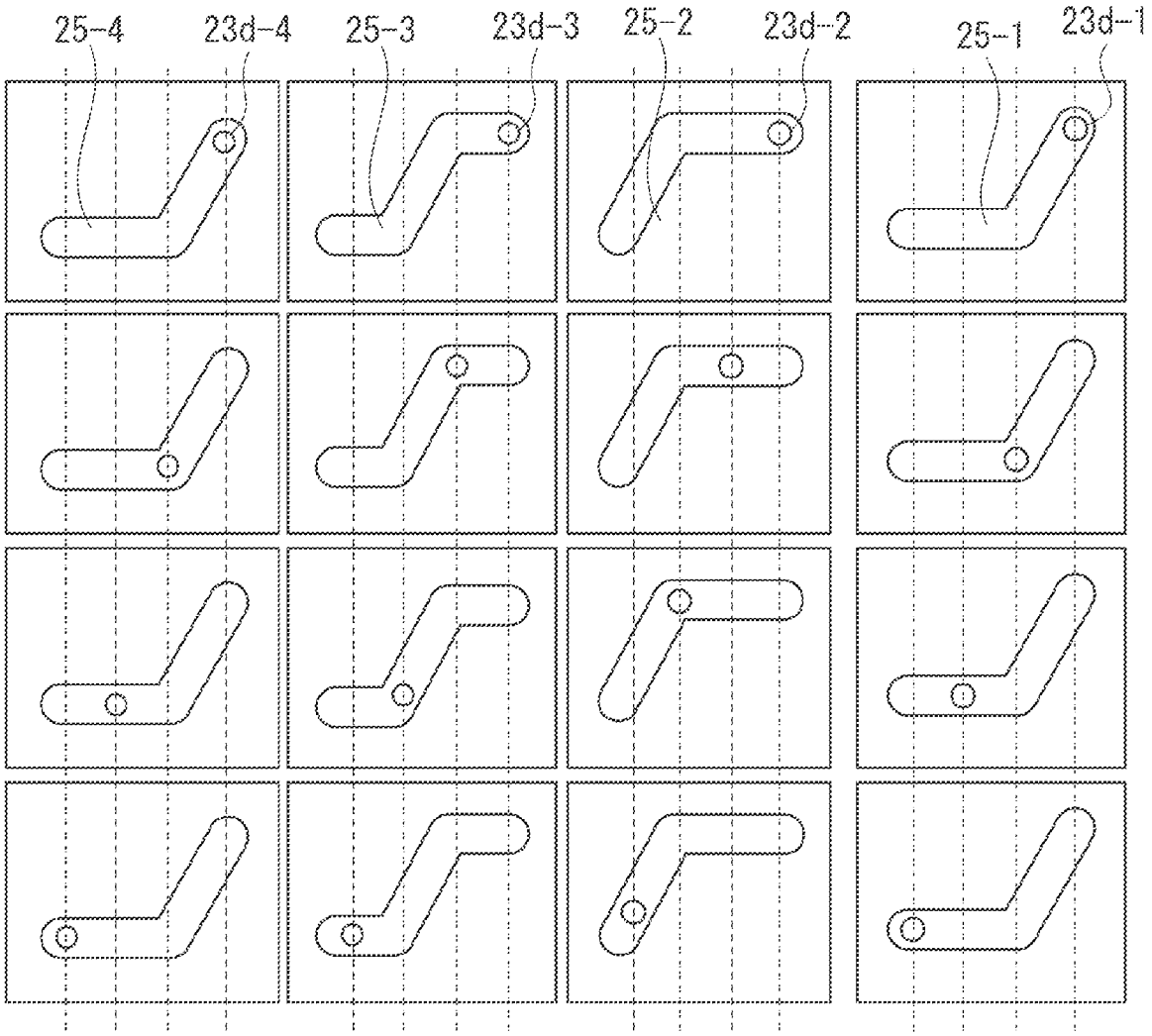
FIGS. 9A, 9B, 9C, and 9D illustrate movement of the movable ribs according to the first exemplary embodiment.

Next, the positions of the movable ribs 21*a* will be described in each mode. FIG. 8A illustrates mode 1 for bordered printing. In mode 1, irrespective of the sheet width, the ink receiving portions 8 do not need to receive ink. Thus, all the movable ribs 21*a* are moved to the respective sheet supporting positions ("SUPPORTING" in FIG. 8) illustrated in FIGS. 2A and 3A.

FIG. 8B illustrates mode 2 for borderless printing on a large-width sheet. In mode 2, only the movable ribs 21*a* arranged in the ink receiving portions 8-1 and 8-4 located near the left and right ends of the sheet are moved to the respective retracted positions ("RETRACTED" in FIG. 8). Meanwhile, the ink receiving portions 8-2 and 8-3 covered by the large-width sheet are moved to the respective sheet supporting positions. This prevents the large-width sheet from sinking, thus making borderless print successful.

FIG. 8C illustrates mode 3 for borderless printing on a medium-width sheet P2. In mode 3, the movable ribs 21*a* in the ink receiving portions 8-1 and 8-3 located near the left and right ends of the medium-width sheet P2 are moved to the respective retracted positions, and the movable rib 21*a* in the ink receiving portion 8-2 covered by the medium-width sheet P2 remains at the sheet supporting position. The movable rib 21*a* in the ink receiving portion 8-4 located away from the medium-width sheet P2 is moved to the retracted position.

FIG. 8D illustrates mode 4 for borderless printing on a small-width sheet P3. The movable ribs 21*a* in the ink receiving portions 8-1 and 8-2 located near the left and right ends of the small-width sheet P3 are moved to the respective retracted positions, and the movable ribs 21*a* in the ink receiving portions 8-3 and 8-4 located away from the small-width sheet P3 are also moved to the respective retracted positions.

FIGS. 9A to 9D illustrate the relationship between each of modes 1 to 4 and the link groove 25, respectively. FIGS. 9A to 9D illustrate crank pins 23*d*-1 to 23*d*-4 of the respective crank shafts 23*b* connected to the respective movable ribs 21*a* in the respective ink receiving portions 8-1 to 8-4. The crank pins 23*d*-1 to 23*d*-4 engage with link grooves 25-1 to 25-4, respectively. When the crank pins 23*d*-1 to 23*d*-4 are positioned high (at the first position) in the respective link grooves 25-1 to 25-4, the movable ribs 21*a* are located at the respective sheet supporting positions. When the crank pins 23*d*-1 to 23*d*-4 are positioned low (at the second position) in the respective link grooves 25-1 to 25-4, the movable ribs 21*a* are located at the respective retracted positions. With the shape of the link grooves 25-1 to 25-4 as illustrated in FIGS. 9A to 9D, the movable ribs 21*a* can be moved as illustrated in FIGS. 8A to 8D.

Figure 10:
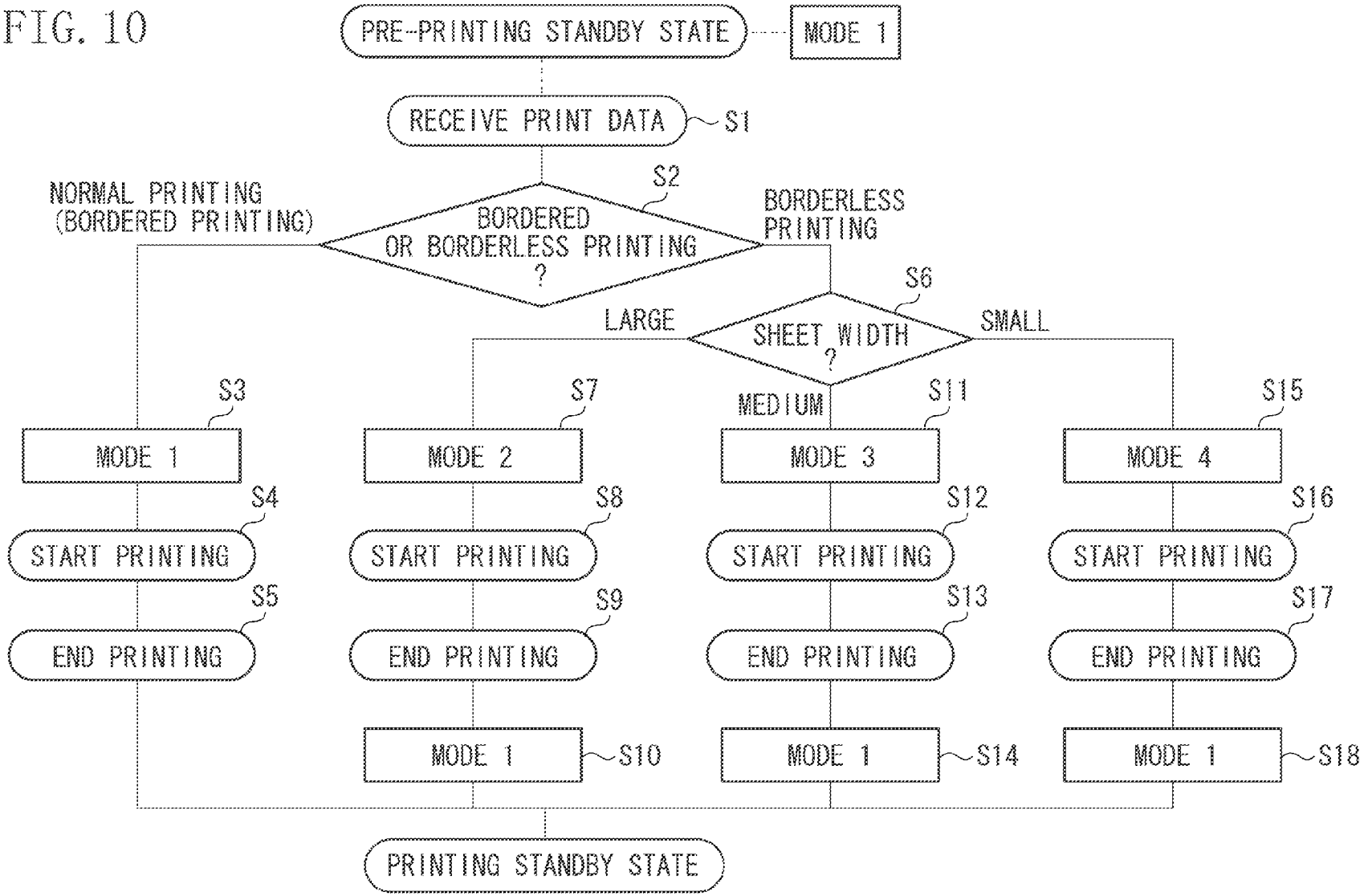
FIG. 10 is a flow chart illustrating movement of the movable ribs according to the first exemplary embodiment.

Next, movement of the movable ribs 21*a* will be described with reference to a flow chart in FIG. 10. The ink jet recording apparatus is in a pre-printing standby state (mode 1). In step S1, the CPU 101 receives print data, and in step S2, the CPU 101 determines whether the print data indicates normal (bordered) printing or borderless printing. If the print data indicates normal (bordered) printing, the operation proceeds to mode 1 in step S3. In step S3, since mode 1 is the same as the standby state, the CPU 101 does not move the movable ribs 21*a* in this case. Next, in step S4, the CPU 101 starts print processing, and in step S5, the CPU 101 ends the print processing.

In step S2, if the CPU 101 determines that the print data indicates borderless printing, the operation proceeds to step S6. In step S6, the CPU 101 determines the width of the sheet. If the CPU 101 determines that the sheet has a large width (LARGE in step S6), the operation proceeds to step S7. In step S7, the CPU 101 moves the movable ribs 21*a* to be arranged as in mode 2 (FIG. 8B). Next, in step S8, the CPU 101 starts print processing, and in step S9, the CPU 101 ends the print processing. After printing, in step S10, the CPU 101 moves the movable ribs 21*a* to be arranged as in mode 1 (FIG. 8A) to return to a standby state.

In step S6, if the CPU 101 determines that the sheet has a medium width (MEDIUM in step S6), the operation proceeds to step S11. In step S11, the CPU 101 moves the movable ribs 21*a* to be arranged as in mode 3 (FIG. 8C). Next, in step S12, the CPU 101 starts print processing, and in step S13, the CPU 101 ends the print processing. After printing, in step S14, the CPU 101 moves the movable ribs 21*a* to be arranged as in mode (FIG. 8A) to return to a standby state.

In step S6, if the CPU 101 determines that the sheet has a small width (SMALL in step S6), the operation proceeds to step S15. In step S15, the CPU moves the movable ribs 21*a* to be arranged as in mode 4 (FIG. 8D). Next, in step S16, the CPU 101 starts print processing, and in step S17, the CPU 101 ends the print processing. After printing, in step S18, the CPU 101 moves the movable ribs 21*a* to be arranged as in mode (FIG. 8A) to return to a standby state.

Figure 11B:
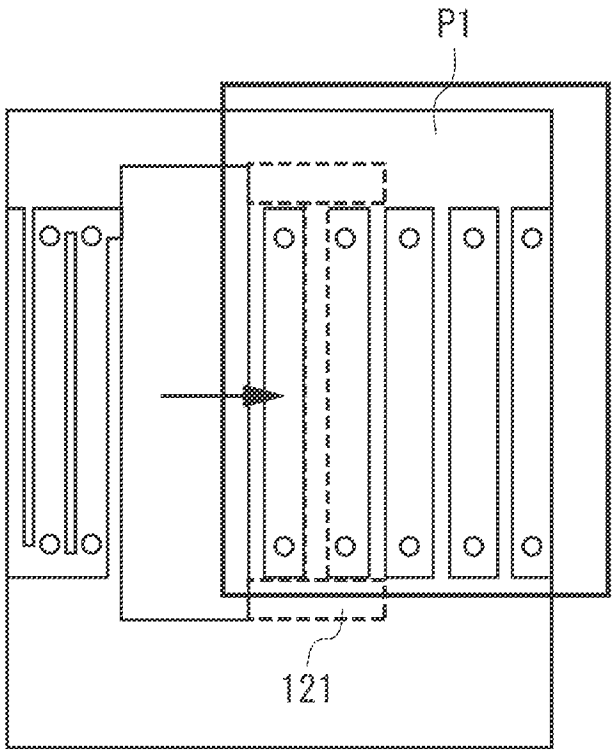
FIGS. 11A and 11B are configuration diagrams illustrating a movable rib according to another exemplary embodiment.
Figure 11A:
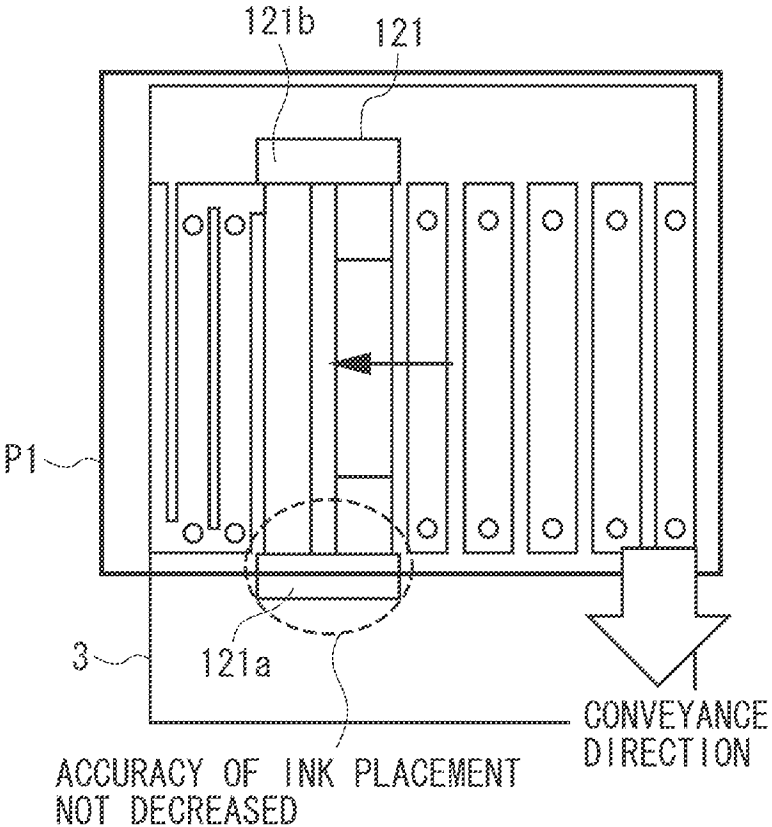
Figure 18A:
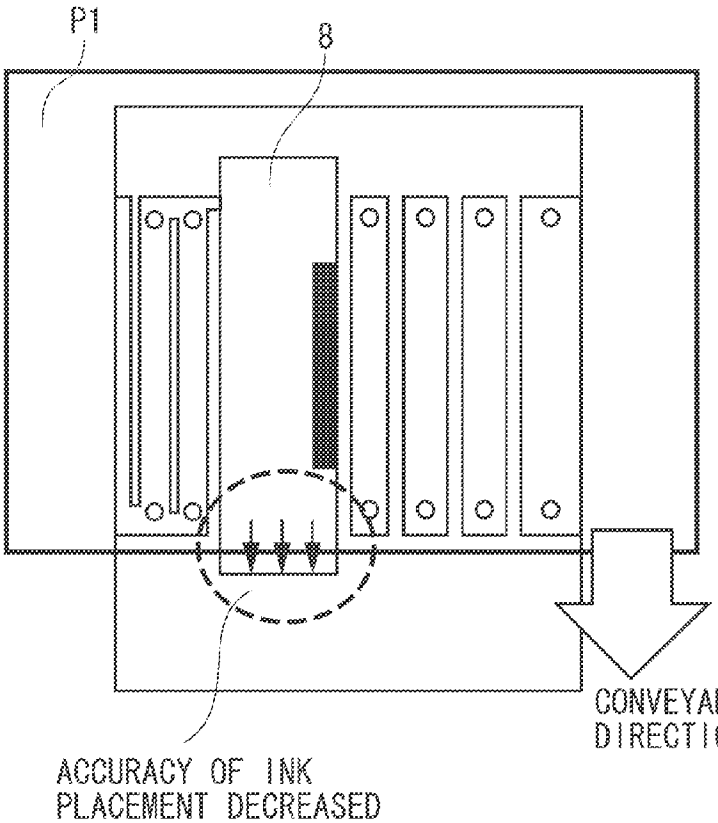
FIGS. 18A and 18B are configuration diagrams illustrating a conventional ink receiving portion.
Figure 18B:
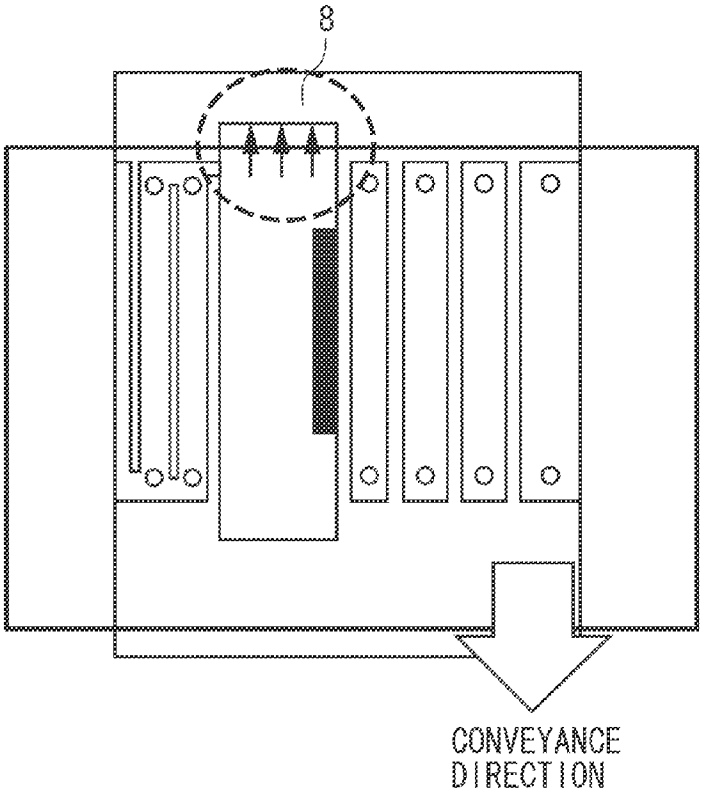

The movable ribs 21*a* may be shaped differently. For example, movable ribs 121 as illustrated in FIGS. 11A and 11B may be used. Advantageous effects provided by the movable ribs 121 in this shape will be described with reference to FIGS. 11A and 11B and FIGS. 18A and 18B. FIG. 18A illustrates a sheet P1 immediately after printing starts based on a conventional configuration. The downstream side end of an ink receiving portion 8 is exposed downstream of the leading edge of the sheet P1. FIG. 18B illustrates the sheet P1 immediately before printing ends. The upstream side end of the ink receiving portion 8 is exposed upstream of the trailing edge of the sheet P1. In these cases, breath flowing into the ink receiving portion 8 decreases accuracy of ink placement at the leading and trailing edges of the sheet P1.

Thus, to solve this problem, the movable ribs 121 are used as illustrated in FIGS. 11A and 11B. Each movable rib 121 includes a downstream-side shielding portion 121*a* for covering the opening at the downstream-side end of an ink receiving portion 8 and an upstream-side shielding portion 121*b* for covering the opening at the upstream-side end of the ink receiving portion 8. These downstream- and upstream-side shielding portions 121*a* and 121*b* can suppress air currents from flowing into the ink receiving portion 8 when recording is executed on near the leading or trailing edge of the sheet P1. As a result, decrease in accuracy of ink placement can be prevented. In addition, the movable ribs 121 near the respective ink receiving portions 8 located at the sheet edges are moved to the respective retracted positions as illustrated in FIG. 11B, thus making borderless printing successful.

Figure 12A:
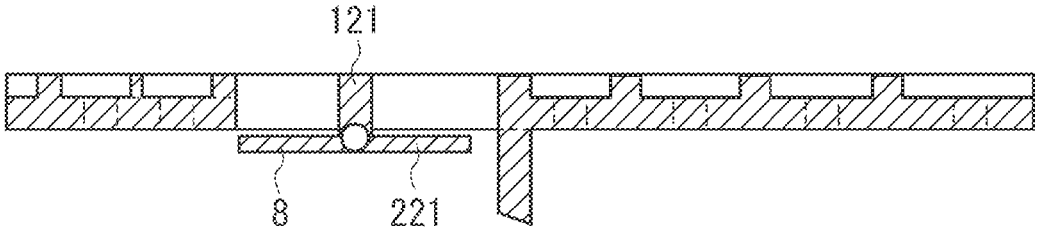
FIGS. 12A and 12B are configuration diagrams illustrating a movable rib according to another exemplary embodiment.
Figure 12B:
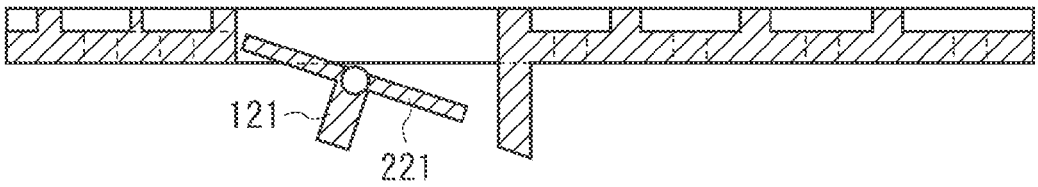

Next, other exemplary embodiments will be described. In the above exemplary embodiment, the movable ribs 21*a* are slid in the main-scanning direction. Alternatively, as illustrated in FIGS. 12A and 12B, each movable rib 121 may be rotatably supported by a movable plate 221 of an ink receiving portion 8 (FIGS. 12A and 12B are sectional views). FIG. 12A illustrates the sheet supporting position used in mode 1. FIG. 12B illustrates the retracted position used in modes 2 to 4, in which the movable ribs 121 are rotated by approximately 180 degrees.

Figure 13B:
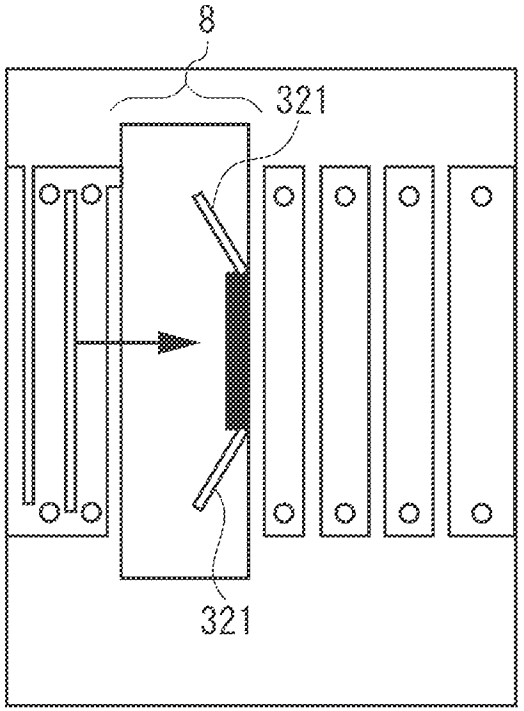
FIGS. 13A and 13B are configuration diagrams illustrating a movable rib according to another exemplary embodiment.
Figure 13A:
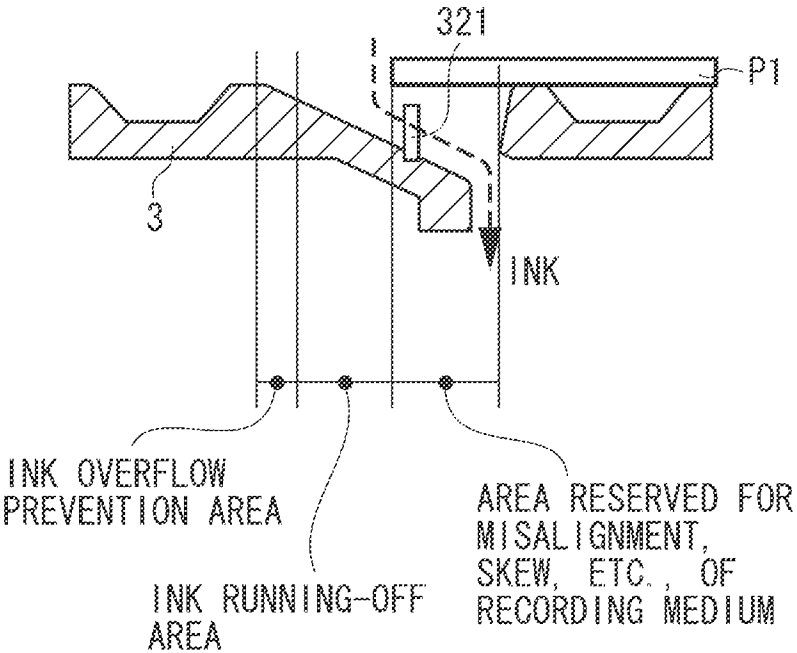
Figure 14:
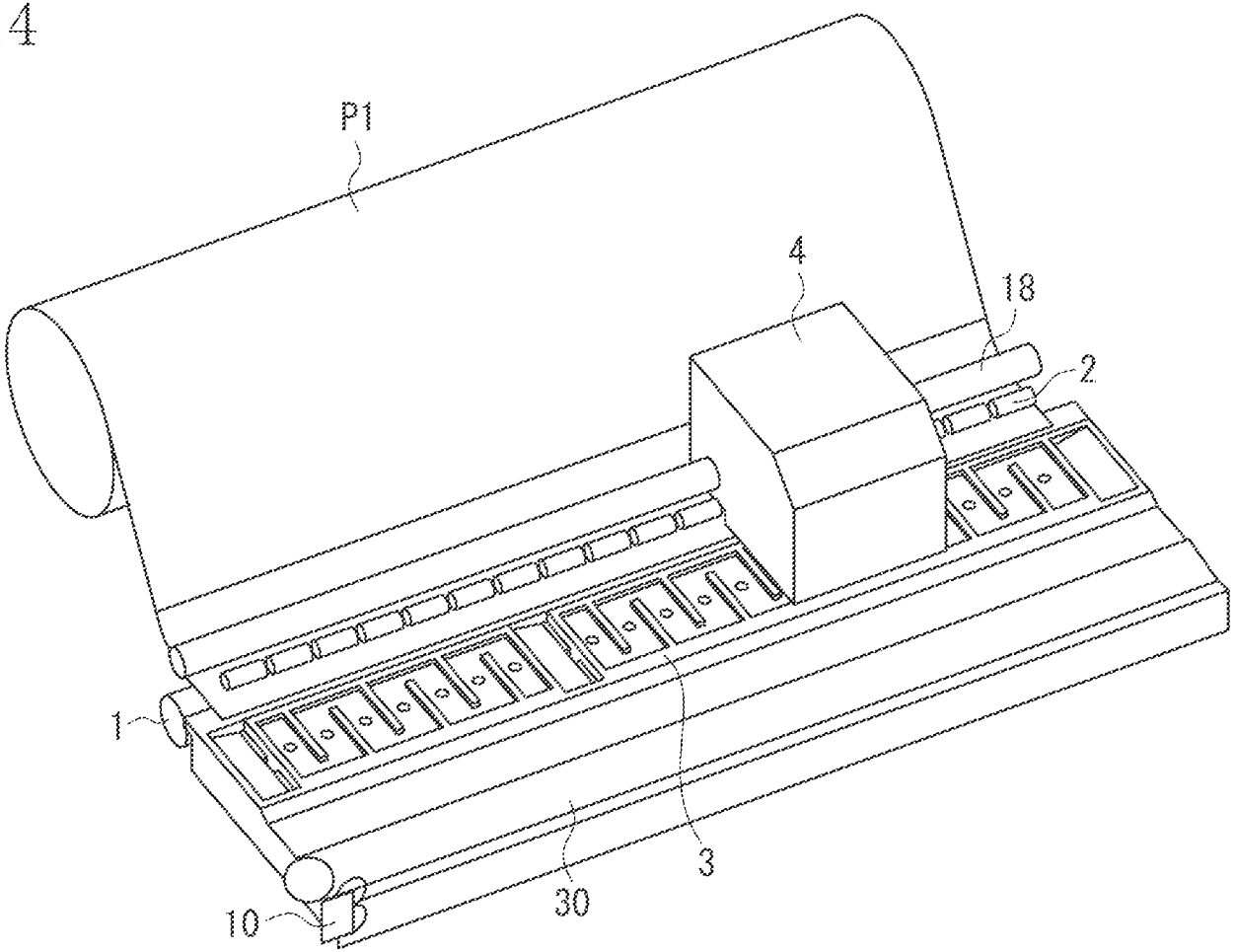
FIG. 14 illustrates a conventional ink-jet recording apparatus.
Figure 15:
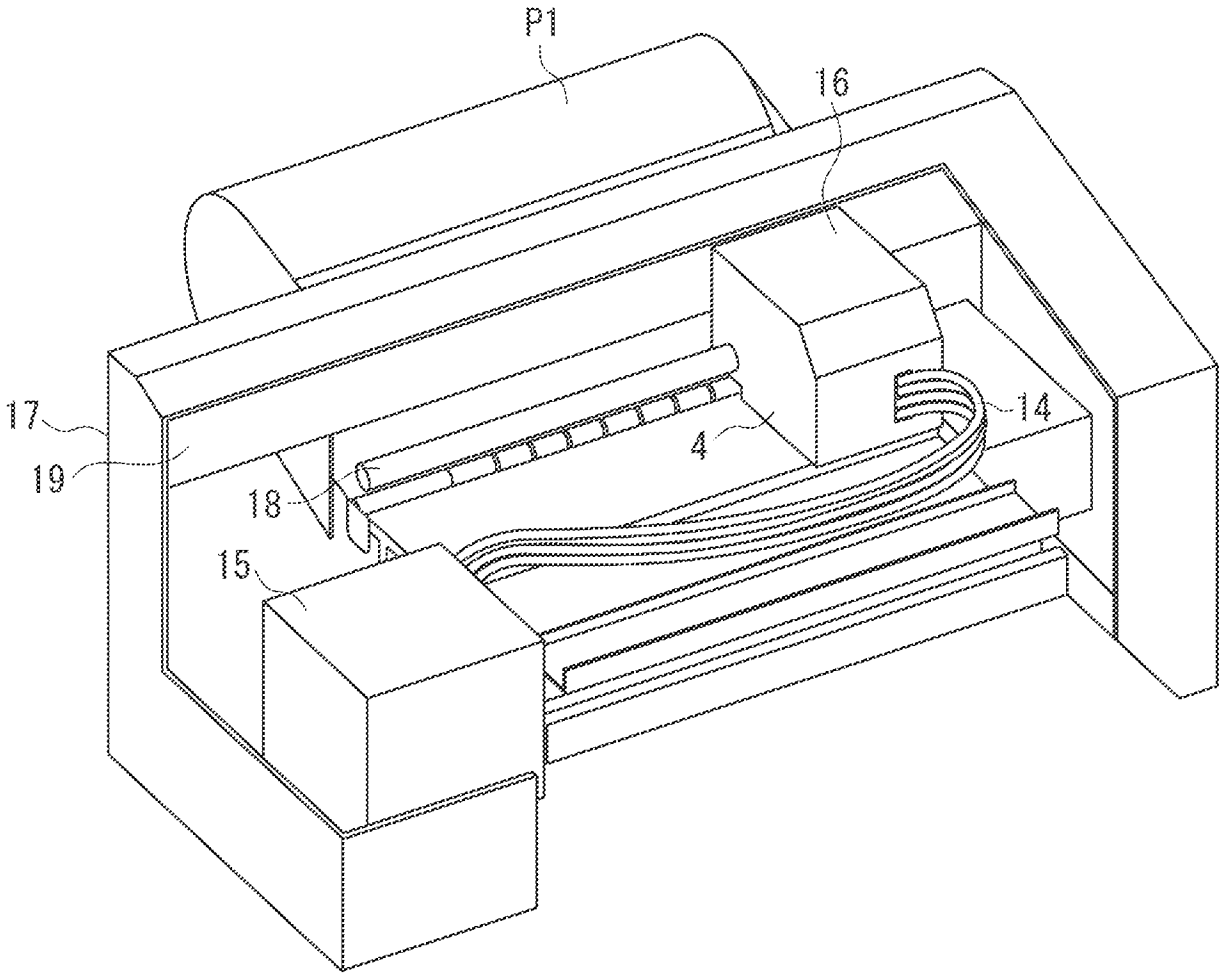
FIG. 15 illustrates a conventional ink-jet recording apparatus.
Figure 16:
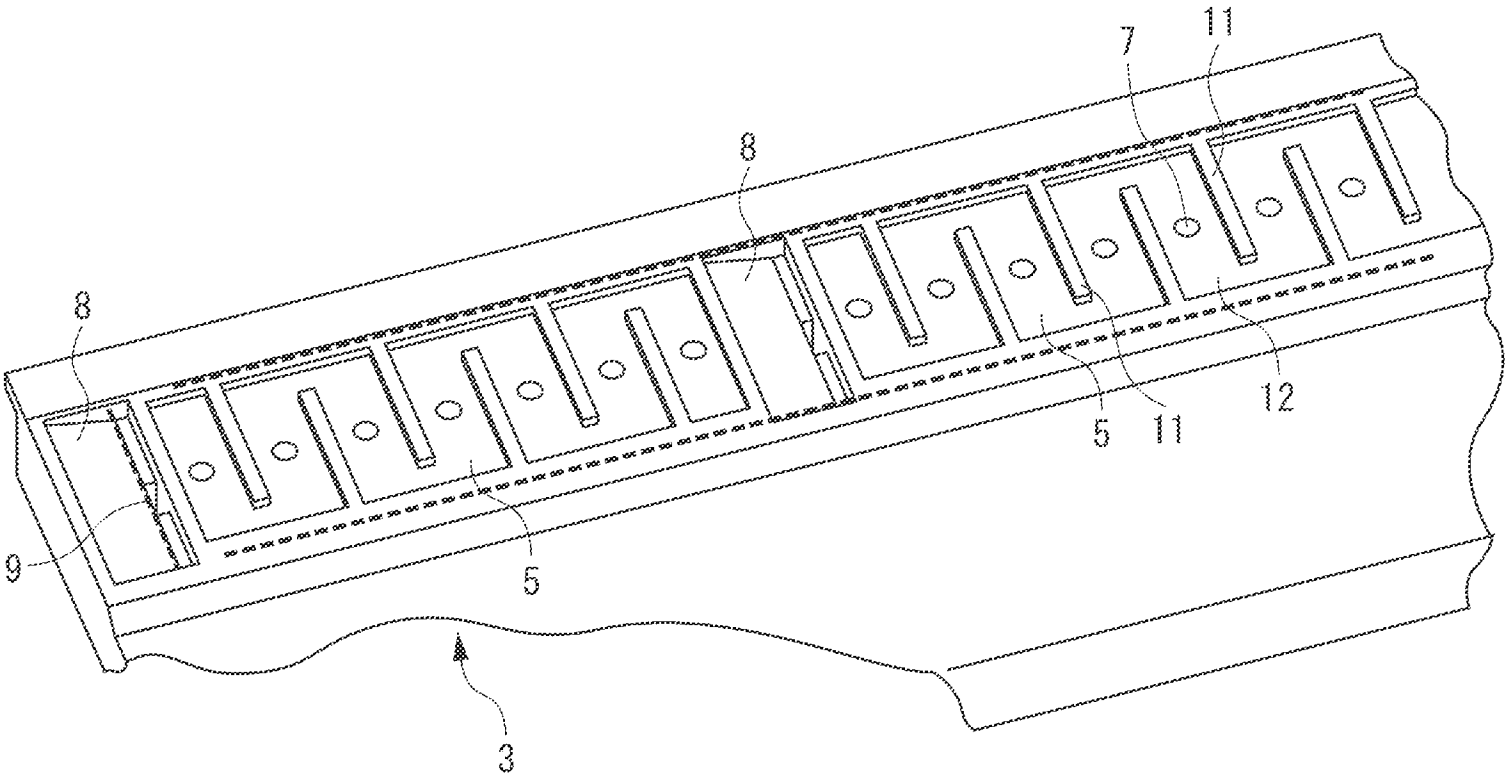
FIG. 16 is an enlarged view illustrating a platen of a conventional ink-jet recording apparatus.
Figure 17B:
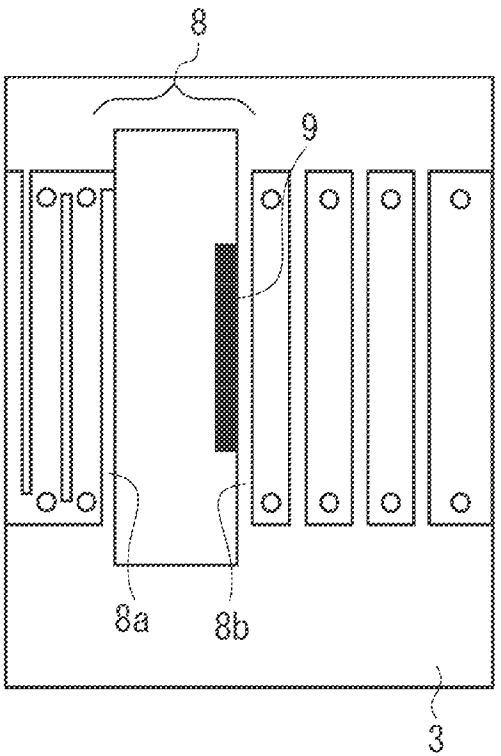
FIGS. 17A and 17B are configuration diagrams illustrating a conventional ink receiving portion.
Figure 17A:
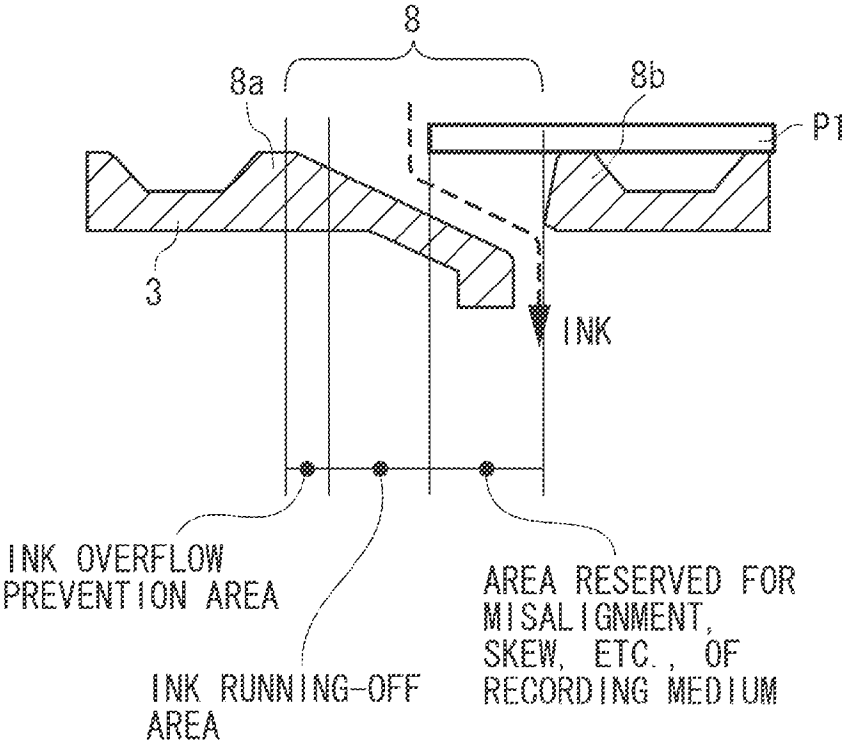

Further alternatively, as illustrated in FIGS. 13A and 13B, fixed ribs 321 may be used. Such fixed ribs 321 used instead of the movable ribs, can provide sufficient advantageous effects. Each fixed rib 321 is arranged to be hidden under the sheet during printing, so that the fixed rib 321 is not stained with ink running off a sheet end. Thus, each fixed rib 321 may be arranged inside of an ink running-off area (an area reserved for dealing with misalignment of the set sheet). However, even if the fixed rib 321 is stained with ink, the user can easily clean the fixed rib 321. Thus, the fixed rib 321 may be arranged in the ink running-off area.

The above movable or fixed ribs have an arbitrary height, as long as the height is equal to or less than the sheet supporting surface of the platen 3. These ribs may be protruded to some extent, which reduces sinking of the sheet. Further alternatively, each of the ribs does not need to be formed as a single straight line in the conveyance direction. As illustrated in FIG. 13B, a plurality of diagonal ribs may be used.

As described in the above exemplary embodiments, by moving the movable ribs arranged in the respective ink receiving portions 8, the groove pitch of the ink receiving portions 8 can be narrowed, as needed. Thus, in borderless printing, negative effects such as uneven marks left on the sheet can be decreased, and image quality can be improved. In addition, since the movable ribs also have a function of opening and closing the respective ink suction ports, the wind speed near the sheet edges is reduced. As a result, image deletion at the sheet edges can be prevented. Moreover, since the movable ribs are characteristically shaped in the sheet conveyance direction, image deletion at the leading and trailing edges of the sheet can be prevented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-158183 filed Jul. 19, 2011, which is hereby incorporated by reference herein in its entirety.

What is claimed is:

1. A recording apparatus for executing recording on a sheet with a recording head that discharges ink, the recording apparatus comprising:

a conveyance unit configured to convey the sheet in a first direction;

a platen arranged opposite the recording head and configured to support the conveyed sheet; and a plurality of ink receiving portions, embedded on the platen, arranged along a second direction intersecting the first direction, and each receiving ink discharged outside of the sheet when borderless printing is performed, wherein; and each of the ink receiving portions has a suction port and a supporting movable member having a rib capable of supporting the from behind, the movable member is being moved with respect to the suction port between a supporting position where the rib supports the sheet within the receiving portion and a retracted position where the rib is retracted, and having the first width and to a second position where the supporting portion does not support the sheet having the first width and supports the sheet having the second width wherein, in the borderless printing, at least a movable member, being one of the movable members each corresponding to one of the ink receiving portions, on which a side edge of the sheet is located is positioned at the retracted position, and at least one of the movable members each corresponding to one of the ink receiving portions which is wholly covered with the sheet is positioned at the supporting position.

2. The recording apparatus according to claim 1, wherein the supporting member moves along with movement of the recording head.

3. The recording apparatus according to claim 1, wherein when the movable member is at the supporting position, the suction port is closed and the rib is located approximately in a middle of the ink receiving portion in the second direction, and when the movable member is at the retracted position, the suction port is opened.

4. The recording apparatus according to claim 1, wherein a height of the supporting member is equal to or less than that of a sheet supporting surface of the platen.

5. The recording apparatus according to claim 1, wherein the ink receiving portion includes a port to be suctioned by the suction portion, and wherein, when the supporting member is located at the first position, the port is closed.

6. The recording apparatus according to claim 1, wherein the supporting member is movable by a drive unit.

7. The recording apparatus according to claim 1, wherein the supporting member includes a plurality of supporting members configured to support the sheet at respective ink receiving portions to prevent the sheet from sinking into the ink receiving portions, wherein the plurality of supporting members are movable by a single drive unit.

8. The recording apparatus according to claim 1, wherein the supporting member includes a plurality of supporting members configured to support the sheet at respective ink receiving portions to prevent the sheet from sinking into the ink receiving portions, wherein, in printing with a margin formed on each of the side edges of the sheet, the plurality of supporting members are moved to the respective first positions, and the inside of each of the ink receiving portions covered by the sheet is suctioned by the suction portion and is kept in negative pressure.

9. The recording apparatus according to claim 1, wherein, in bordered printing, at least a movable member, being one of the movable members each corresponding to one of the ink receiving portions, on which a side edge of the sheet is located is positioned at the retracted position, and at least one of the movable members each corresponding to one of the ink receiving portions which is wholly covered with the sheet is positioned at the supporting position.

10. The recording apparatus according to claim 1, wherein the supporting member has a shape capable of covering an upstream-side end or a downstream-side end of the ink receiving portion in a sheet conveyance direction.

11. The recording apparatus according to claim 1, wherein the supporting member is rotatably supported and is movable to the first and second positions by being rotated.

12. The recording apparatus according to claim 1, further comprising a suction unit configured to suck ink from the ink receiving portion.

13. The recording apparatus according to claim 12, wherein the suction unit is able to suck ink in a case where the supporting member moves to the first position and the suction unit is not able to suck ink in a case where the supporting member moves to the second position.

14. The recording apparatus according to claim 13, wherein an ink suction port which passes through the ink receiving portion and the suction unit is closed by the supporting member in a case where the supporting member moves to the second position.

15. The recording apparatus according to claim 14, further comprising a drive unit configured to move the supporting member to the first position and to the second position.

* * * * *